United States Patent [19]

Engstrom et al.

[11] Patent Number: 4,587,517

[45] Date of Patent: May 6, 1986

[54] INTRUSION SENSING DEVICE

[75] Inventors: John G. Engstrom; Robert A. Till, Jr., both of Indianapolis, Ind.

[73] Assignee: AT&T Technologies, Inc., Berkeley Heights, N.J.

[21] Appl. No.: 695,514

[22] Filed: Jan. 28, 1985

[51] Int. Cl.[4] ..... G08B 13/08; G08B 13/06

[52] U.S. Cl. ..... 340/542; 200/61.08; 200/61.93; 340/545

[58] Field of Search ..... 340/542, 545, 550; 200/61.93, 61.08

[56] References Cited

U.S. PATENT DOCUMENTS

| | | | |
|---|---|---|---|
| 2,859,430 | 11/1950 | O'Callaghan | 340/542 |
| 2,927,311 | 3/1960 | Donaldson | 340/274 |
| 3,714,644 | 1/1973 | Hellstrom | 340/652 |
| 4,000,488 | 12/1976 | Ephraim | 340/568 |
| 4,233,595 | 11/1980 | Landkammer | 340/542 |
| 4,390,867 | 6/1983 | Queren | 340/542 |

*Primary Examiner*—Glen R. Swann, III

*Attorney, Agent, or Firm*—M. A. Morra

[57] ABSTRACT

An apparatus for detecting the forced opening of a door. The apparatus comprises a paper sheet with a frangible conductive path thereon. The sheet has holes therein for the passage of a retractable bolt and fasteners, which are used to secure a strike plate to a frame. The sheet is then concealed behind the strike plate and the conductive loop surrounds the fastener holes. When the door is forced open without retraction of the bolt, a crack appears on the surface of the frame surrounding the fasteners. This crack causes a break in the conductive loop. This break is then detected by a detecting device electrically connected to a part of the loop, thereby triggering an alarm.

12 Claims, 3 Drawing Figures

INTRUSION SENSING DEVICE

TECHNICAL FIELD

This invention relates generally to the subject of intrusion sensing devices. The intrusion that is detected is the forcible displacement of a member, such as a door, mounted within a frame without retraction of a retractable bolt, the bolt being incorporated in the member, and used for latching the member in the frame.

BACKGROUND OF THE INVENTION

This invention relates to the problem of finding a concealable, inexpensive and universally adaptable intrusion sensing device for doors and windows.

A recent development in door alarm systems is disclosed in U.S. Pat. No. 4,233,595 to F. Landkammer on Nov. 11, 1980. This development, is adaptable to almost all door lock systems and does not require movement of frame parts relative to each other. The apparatus disclosed in Landkammer has two pieces which are called supports joined together by a flexible cord with a pair of conductors therein. The first support is mounted on a door, and the second support is mounted on a door frame or in an area close thereto. The flexible cord is permanently fixed to the first support on one end and has an end piece which is inserted into the second support on the other end. The second support also contains two frangible conductive elements which connect to the conductors in the cord at one end and to a resistor at the other end. These strips are then situated under a large head of a screw. If one opens the door and puts tension on the cord, the conductors in the two strips will either be shorted together by the screw head, or one or both of the conductors in the strips will break. Either event will cause a change in resistance in a conductive loop resulting in the triggering of an alarm. Breaking the cord or shorting the conductors in the cord together will also trigger the alarm.

Landkammer, however, is not without its shortcomings. If an intruder opens the door slightly so as not to break any conductors, he will see the cord and can react accordingly. Also, with this alarm system, the user must remember to arm and disarm the system. Otherwise, an alarm will be triggered when there is a non-intrusive entry, or the alarm will not trigger when there is an intrusive entry. Arming the system requires opening the door and holding it slightly open, reaching inside the opening and inserting the end piece of the cord into the second support. Disarming also requires slightly opening the door, reaching inside and using a key to detach the cord's end piece from the second support. Another disadvantage of Landkammer, as can be seen above, is that the apparatus in this disclosure requires many parts such as two supports and an interconnecting cord.

A more recent development in the area of door alarm systems is disclosed in U.S. Pat. No. 4,390,867 to J. Queren on June 28, 1983. With this development, a flange projects from a backer plate into a latch bolt hole in a door frame. The flange is slightly spaced from the latch bolt when the latch bolt is in the latch bolt hole of the door frame. When the latch bolt is displaced toward the side of the hole, the flange is slightly bent, thereby closing a normally open circuit setting of an alarm. However, this alarm system is not easily installed, requires many parts and is not easily adaptable to locks that have been previously installed without this alarm system. This alarm system requires a backer plate and a reinforcement plate, which is in addition to the strike plate used in most door latch bolt locks. Conductors must also be connected to the reinforcement and backer plate.

Thus, the prior art discloses various door alarm systems which respond to intrusion; however, these door alarm systems are not without their shortcomings. Many of these systems require extensive modification of the door locks. Many other of these systems require numerous parts, are not concealable, and must be deactivated and reactivated for non-intrusive and intrusive openings, respectively.

There is, therefore, a need to provide an intrusion sensitive door alarm which is concealable, inexpensive, easy to install and adaptable to most door locks.

There is a further need to provide a passive sensor that is automatically armed when the door is locked and disarmed when the door is unlocked without requiring any additional action by the user.

SUMMARY OF THE INVENTION

The foregoing needs are satisfied with the intrusion sensing device disclosed herein. The intrusion device disclosed in this application is concealable, inexpensive and easy to install. This device is also shaped so that it is usable in standard door frames and any frames which have holes therein for receiving a protrusion such as, for example, a retractable bolt.

The invention disclosed herein is an intrusion sensing device which comprises a nonconductive sheet with a frangible conductive loop thereon. This device is designed to be bonded to the surface of a door frame, and the loop is designed so that it breaks when the portion of the frame under the intrusion sensing device is fractured by a forced opening of the door. The loop is connected to a detecting device which senses the break and causes an alarm to sound.

More specifically, in one embodiment the intrusion sensing device is comprised of two first portions and one second portion. The two first portions, referred to as ends, each have a different configuration, and the ends are interconnected by a narrow strip, which is the second portion. Only one end is used, that being the end having the configuration adapted to be hidden behind a strike plate on the particular door frame of interest. Each end has an opening to allow the passage therethrough of a door latch bolt and holes to receive fasteners used to secure the strike plate to the frame. One surface of the sensing device is covered with a layer of adhesive which is itself overlayed with a thin removable non-adhesive covering. The conductive loop is a closed loop which passes through the length of the interconnecting strip and surrounds the fastener holes in the ends.

To install the intrusion sensing device, fasteners holding the strike plate in place and the strike plate itself are first removed from the door frame. Then the non-adhesive covering is removed from the sensing device to expose the adhesive layer. The end of the device that is of a configuration to be hidden behind the strike plate is then placed with the adhesive side contacting the door frame so that the latch bolt opening in the end is aligned with a latch bolt hole in the door frame and so that the fastener holes in the end align with holes in the frame for the strike plate fasteners. This end is then firmly pressed against the frame to bond it in place and the unused end is cut off. The interconnecting strip is placed behind the door molding or bonded to the face of the molding in the manner described above. The interconnecting strip is connected to a detecting device and the strike plate is then refastened to the door frame to complete the installation.

When a burglar forces the door open with the latch bolt fully extended into the latch bolt hole of the door frame, the latch bolt contacts the strike plate and displaces it in a direction generally parallel to the surface of the frame. The strike plate fasteners are thereby displaced in the same direction. This displacement fractures the frame in the area surrounding the fasteners thus tearing the sensor which has been bonded to the frame whereby the conductive loop is broken. The break in the conductive loop is sensed by the detecting device which in turn triggers an alarm.

Thus, the structure, installation and operation of the intrusion sensing device are a solution to the aforementioned problems in the prior art. The structure can be manufactured inexpensively. The shape of the structure is designed to be hidden behind the strike plate and is thus not visible to a would be burglar. The device is adaptable to a large number of door frames since either of two ends may be used. The installation, as described above, requires no major modification of the door frame, and the intrusion device is merely placed on the door frame and connected to a detecting device. The intrusion device also requires no arming and disarming for effective operation. One need not, for example, reach inside a door to disarm or arm an alarm or remember to arm or disarm an alarm. If the door is opened in the normal fashion, i.e., with retraction of the latch bolt out of the latch bolt hole in the door frame and into the door, no alarm will be triggered, even though the alarm is armed.

BRIEF DESCRIPTION OF THE DRAWING

Other features and advantages of the invention, its organization, construction and operation will be best understood from the following detailed description of a specific embodiment thereof, taken in conjunction with the accompanying drawings in which.

EMBODIMENT OF THE INVENTION

Figure 1:
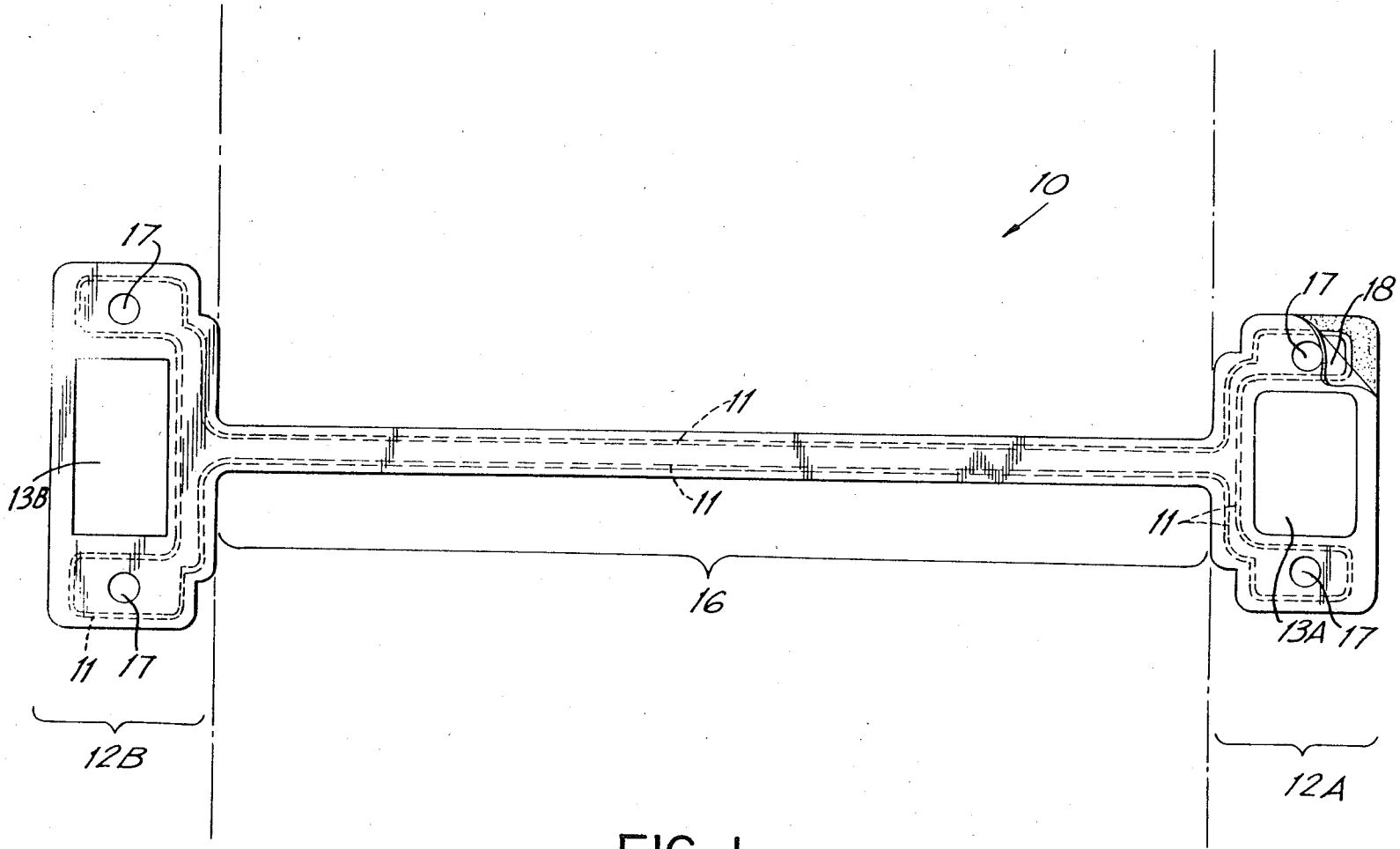
FIG. 1 is a schematic drawing of the intrusion sensing device.

FIG. 1 shows an embodiment of the intrusion sensing device 10 which consists of two end or first portions 12A and 12B joined by and at opposite ends of an interconnecting or second portion 16. The two ends 12A and 12B include openings 13A, 13B and holes 17 to allow the passage therethrough of a retractable latch bolt 32 (see FIG. 3) and fasteners 37 (see FIG. 2). The two end portions 12A and 12B, as well as the latch bolt openings 13A and 13B therein, are of two different sizes so as to match and be completely concealed behind various strike plate (see 25 of FIG. 3) sizes. The end and interconnecting portions are made of a paper base with an adhesive on one side. The adhesive side has a removable cover layer 18. Included as part of the end and interconnecting portions is a frangible electrically conductive path 11 in the form of a closed loop which extends through the length of the interconnecting portion 16 and surrounds the holes 17 in each of the end portions 12A and 12B. The conductive path 11 can be made of any frangible conductive material such as conductive ink.

Figure 2:
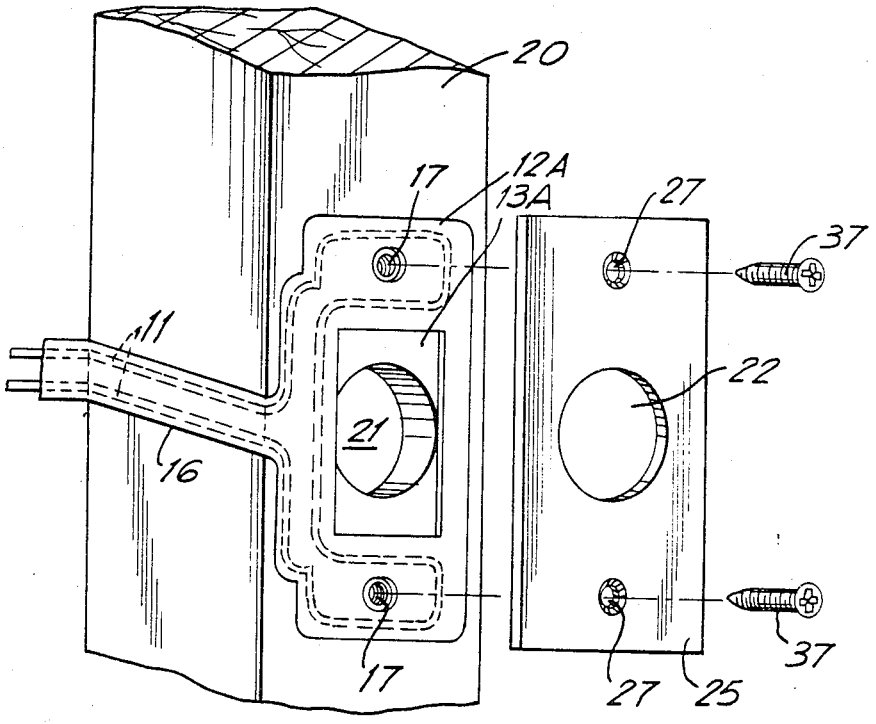
FIG. 2 is a schematic drawing of part of a frame with a hole therein and the intrusion sensing device installed thereon.
Figure 3:
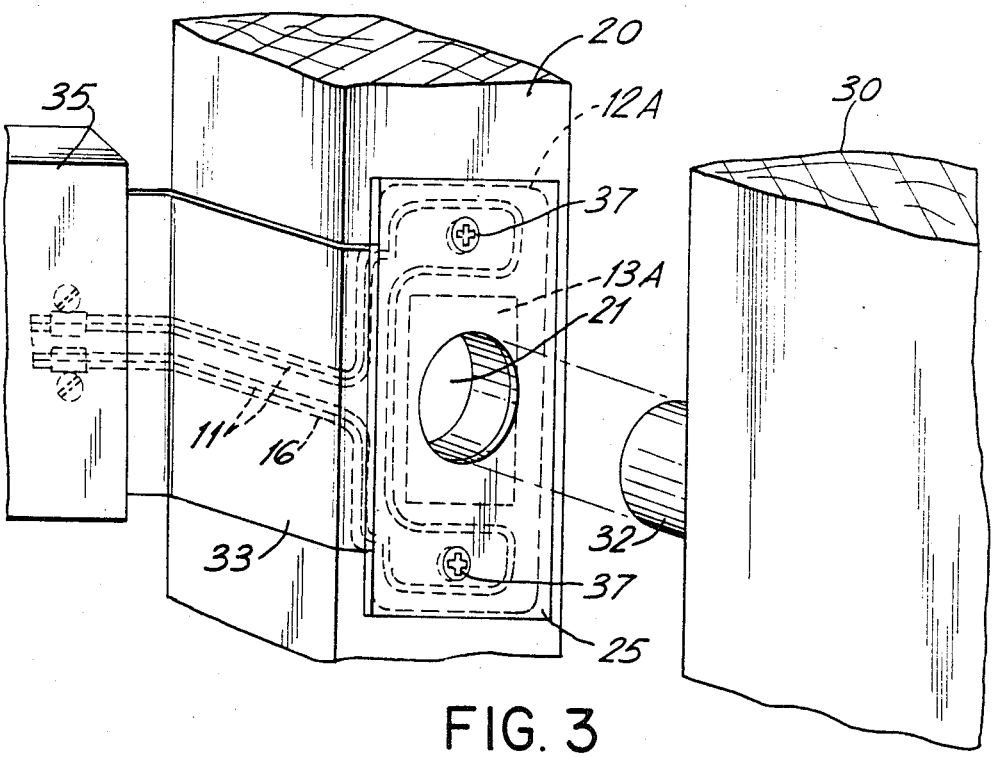
FIG. 3 is a schematic drawing of part of a frame with a strike plate thereon which conceals the intrusion sensing device.

Referring to FIGS. 2 and 3, installation of the intrusion sensing device is as follows. First, the strike plate 25 is removed from a door frame 20 by removing the fasteners 37 holding the strike plate 25 to the frame. Then the removable cover 18 (see FIG. 1) is removed so as to expose a layer of adhesive, and the appropriate end, say for example 12A, is bonded to the door frame 20 by pressing the exposed adhesive layer on the surface of the frame. The end must be placed on the frame 20 so that the holes 17 in the end 12A align with holes for the fasteners 37 in the frame and so that the opening 13A aligns with latch bolt hole 21 in the frame. Then, the strike plate 25 is placed back on the frame 20, and the fasteners 37 are reinserted into the frame. The unused end 12B is cut off at some point on the second portion 16 so as to allow two conductors 11 of the second portion to be electrically connected to a detecting device 35. Tape 33 is placed over a part of the second portion 16 between the strike plate 25 and the detecting device 35.

Again referring to FIGS. 2 and 3, when a member, such as door 30, which is mounted within the frame 20, is in the closed position, a protrusion, such as latch bolt 32, from the member is generally in the frame latch bolt hole 21 and in strike plate latch bolt hole 22. Generally, when one tries to open the door from a closed position without retraction of the latch bolt 32, a certain minimal force is exerted by pushing on the door, which force is transmitted to the strike plate 25 by the latch bolt 32. This force is also transmitted to the fasteners 37 in a direction generally parallel to the surface of the strike plate 25. This latter force causes a slight displacement of the strike plate 25 in turn causing the surface of the frame surrounding the fasteners 37 to fracture. The conductor path 11 in the end portion 12A which overlays the fracture breaks as a result of the fracture. This break is then detected by the detecting device 35, which triggers the alarm. However, if the door is opened in the normal manner by retraction of the bolt before opening, no alarm will be triggered.

We claim:

1. An intrusion sensing device for use on a frame having a hole therein for receiving a protrusion, the protrusion extending from a movable member, the intrusion sensing device comprising:

a first portion adapted to be attached to a surface of the frame under a strike plate fastened on the surface of the frame, the first portion including an electrically conductive path which is constructed so that it is broken when the member is displaced in a direction generally parallel to the strike plate surface without retracting the protrusion into the member; and a second portion joined to the first portion, the second portion adapted to extend between the first portion and a means for detecting the breaking of the conductive path including means for electrically connecting the conductive path of the first portion to the detecting means.

2. The apparatus as recited in claim 1, wherein the protrusion is a retractable bolt.

3. The apparatus as recited in claim 1, wherein the first portion is of a shape to be concealed under the strike plate of the frame.

4. The apparatus as recited in claim 1 wherein the first portion has openings therein to align with the hole in the frame for receiving the protrusion and to surround holes in the frame for receiving fasteners that fasten the strike plate to the frame.

5. The apparatus as recited in claim 1 wherein the combination of the first and second portions comprises a frangible nonconductive sheet having only one frangible conductive path thereon.

6. An intrusion sensing device for detecting movement, without retraction of a latch bolt, of a member from a closed position within a frame to which the member is movably attached, wherein the bolt passes through a latch bolt hole in a strike plate and frame when the bolt is unretracted and the member is in the closed position, and wherein the strike plate is fastened to the frame, the intrusion sensing device comprising:

(a) a frangible, nonconductive, sheet to be bonded to the frame under the the strike plate, the sheet having openings therein that conform to a plurality of latch bolt hole sizes; and (b) a frangible, conductive path attached to the sheet which path is broken when the latch bolt displaces the strike plate in a direction which is in a plane generally parallel to and generally coincident with the surface of the strike plate.

7. The apparatus as recited in claim 6, wherein the strike plate is fastened to a frame by a plurality of fasteners which extend through the strike plate and into the frame and wherein the conductive path surrounds at least one of the fasteners.

8. An intrusion sensing device for detecting an intrusive opening of a door mounted within a frame without retraction of a latch bolt incorporated in the door and which unretracted bolt passes through a latch bolt hole in the frame and through a latch bolt hole in a strike plate when the door is in the closed position, and which strike plate is fastened to the frame by a plurality of fasteners passing through the strike plate and into the frame, the intrusion device comprising:

(a) a frangible, nonconductive, adhesive sheet adapted to be bonded to the frame and concealed under the strike plate, and having openings therein to surround the latch bolt hole in the frame and to surround fastener holes in the frame; and (b) a single frangible conductive path on the sheet which path is for surrounding the fasteners and for electrically connecting to a detecting means and which path is broken when there is a crack in the surface of the frame surrounding any of the fasteners, which crack is caused by the displacement of the fasteners in a direction generally transverse to the length of the fasteners when the door is forced open without retraction of the bolt, and which break in the path is detected by the detecting means.

9. The apparatus as recited in claim 8 wherein the sheet is a paper sheet with a removable cover on an adhesive side of the sheet, which side is used to bond the sheet to the frame when the cover is removed.

10. A method of detecting the intrusive opening of a member mounted within a frame without retraction of a latch bolt incorporated in the member and which unretracted bolt passes through a latch bolt hole in the frame when the member is in a closed position, the method comprising the steps of:

bonding an adhesive frangible electrical conductor on the surface of the frame in an area which cracks when the member is displaced in a direction generally perpendicular to the depth dimension of the hole so that the conductor will break in response to the crack; and electrically connecting the conductor to a detecting means which triggers an alarm when the conductor is broken.

11. A method of detecting the intrusive opening of a member mounted within a frame without retraction of a latch bolt incorporated in the member and which unretracted bolt passes through a latch bolt hole in the frame and through a latch bolt hole in a strike plate when the member is in a closed position and which strike plate is fastened to the frame, the method comprising the steps of:

removing the strike plate from the frame;

bonding an adhesive frangible electrical conductor on the surface of the frame on an area which was covered by the strike plate and which area cracks when the member is displaced without retraction of the bolt in a direction generally perpendicular to the depth dimension of a latch bolt hole so that the conductor will break in response to the cracking in the area;

placing the strike plate back on the frame so that the unretracted bolt can pass through the latch bolt hole in the frame and the latch hole in the strike plate; and electrically connecting the conductor to a detecting means which triggers an alarm when the conductor is broken.

12. The method as recited in claim 11 wherein the conductor is also placed so that it surrounds a fastener such that the conductor will break when a crack is caused by a minimum force on the fastener in a direction generally parallel to the surface of the strike plate, which force occurs when one opens or attempts to open the member without retraction of the bolt.

* * * * *